United States Patent [19]

Tucker

[11] Patent Number: 4,947,532

[45] Date of Patent: Aug. 14, 1990

[54] SCALER HOLDER

[76] Inventor: Edward L. Tucker, 232 S. French Ave., Arlington, Wash. 98223

[21] Appl. No.: 409,410

[22] Filed: Sep. 19, 1989

Related U.S. Application Data

[63] Continuation-in-part of Ser. No. 286,037, Dec. 19, 1988, abandoned.

[51] Int. Cl.[5] ..... B21C 43/00

[52] U.S. Cl. ..... 29/81.14; 173/51; 173/73

[58] Field of Search ..... 173/51, 57, 73; 29/81 D

[56] References Cited

U.S. PATENT DOCUMENTS

| | | | |
|---|---|---|---|
| 1,405,930 | 2/1922 | McGrath | 29/81 D |
| 1,585,740 | 5/1926 | Saulia . | |
| 1,657,779 | 1/1928 | Bly | 29/81 D |
| 1,684,668 | 9/1928 | Gartin . | |
| 1,727,816 | 9/1929 | Doull | 29/81 D |
| 1,745,100 | 1/1930 | Johnston et al. | 29/81 D |
| 2,136,315 | 11/1938 | Pettit | 29/81 D |
| 2,345,412 | 3/1944 | Moore | 80/60 |
| 2,533,435 | 5/1951 | Briese | 29/81 |
| 2,562,899 | 8/1951 | Finn | 29/81 |
| 3,366,420 | 1/1968 | Young | 299/37 |
| 3,680,643 | 8/1972 | Cameron et al. | 173/133 |
| 3,937,055 | 2/1976 | Caruso et al. | 72/299 |
| 4,694,546 | 9/1987 | Rawlings | 29/81 |

FOREIGN PATENT DOCUMENTS

| | | | |
|---|---|---|---|
| 333995 | 3/1921 | Fed. Rep. of Germany | 29/81 D |

*Primary Examiner*—Hien H. Phan
*Assistant Examiner*—Scott A. Smith

[57] ABSTRACT

A holder for a plurality of scalers including a rectangular tube 2 forming the main body portion and including coaxial bores in opposite walls 8,10 to secure the scalers 14 and permit easy removal and axial adjustment of individual tools.

3 Claims, 2 Drawing Sheets

SCALER HOLDER

CROSS-REFERENCE TO RELATED APPLICATION

This is a continuation-in-part of application Ser. No. 286,037, filed on Dec. 19, 1988 now abandoned.

1. Technical Field

This invention relates to devices for cleaning decking or the like and, more particularly, to an apparatus for holding and guiding a plurality of commercially available scalers or needle guns permitting easy removal of a single gun for individual use and providing for axial adjustment of the indiviudal guns assuring uniform contact with the surface to be scaled and reducing breakage.

2. Background Art

The maintenance of decking, such as steel decks on boats or the like, has generally required chipping or scaling to remove the paint, spillage, rust or anything else that needed to be removed prior to the final preparation and painting of the surface.

Originally the cleaning and/or chipping was done largely by hand, oftentimes with a handheld tool and a hammer. This chipping process evolved to the point where a reciprocating motion was given to a chisel, again usually handheld, by a pneumatic cylinder. The process later evolved through the use of what is known as a needle gun wherein a pneumatic cylinder causes the reciprocation of a plurality of captured rods or needles causing multiple, small point impact during each stroke, which has greatly increased the efficiency of the process. It is still fairly standard, however, for the operator either to bend over or be on his knees holding one of the needle guns as he proceeds over the surface to be refinished.

The process as described hereinabove is slow, tedious, puts stress on the operator's hand and arm because of the continuous vibration, puts stress upon the operator's knees and/or back because of the position assumed. Further, the process of scaling with a handheld tool endangers the operator because of the proximity of the operator's unprotected anatomy to the scaling operation and the inherent possibility of flying paint chips or other debris.

As with any tool, the needle gun or scaling tool will have a far greater expected life if used properly and, in the case of the needle gun type scalers, the device should ideally be perpendicular to the surface being cleaned, should be operated under a prescribed air pressure and further must be appropriately lubricated.

Some of these operational concerns are addressed by the present invention which encourages proper deck contact and which also allows an individual operator to operate more than one of the needle guns simultaneously, increasing his efficiency.

PRIOR ART

Prior art known to the present inventor includes U.S. Pat. No. 1,585,740, granted to Saulia May 25, 1926, for a pneumatic tool including a plurality of pneumatic hammers within a single body for simultaneous reciprocal action for scaling or the like. U.S. Pat. No. 1,684,668, granted to Gartin Sept. 18, 1928, discloses a lubrication mechanism for use in a pneumatic drill.

U.S. Pat. No. 2,345,412, granted to Moore Mar. 28, 1944, discloses a method for manufacturing billets including the disclosure of a plurality of torches which are held in a common carrier to move along and clean the surface of a manufactured billet.

U.S. Pat. No. 2,553,435, granted to Briese May 15, 1951, discloses a deck scaler having a plurality of chisels held in a common carrier which is moved along the deck in a wheeled cart.

U.S. Pat. No. 2,562,899, granted to Finn Aug. 7, 1951, likewise discloses a pneumatic deck scaling machine wherein a plurality of hammers are moved along the deck in a wheeled cart.

U.S. Pat. No. 3,366,420, granted to Young on Jan. 30, 1968, likewise discloses a plurality of deck scalers which are fed from a common pneumatic source and are moved along the deck in a wheeled cart.

U.S. Pat. No. 3,680,643, granted to Cameron et al Aug. 1, 1972, discloses a fluid activated scaling device of the type the current invention is designed to utilize.

U.S. Pat. No. 3,937,055, granted to Caruso et al Feb. 10, 1976, discloses a modification of the device of Cameron et al and likewise a device which could be used in the current inventive device.

U.S. Pat. No. 4,694,546, granted to Rawlings Sept. 22, 1987, discloses an apparatus for stripping paint and includes, as a part of the apparatus, a plurality of needle chisels mounted in a common holder.

DISCLOSURE OF THE INVENTION

With the above-noted prior art and problems in mind, it is an object of the present invention to provide a holder for a plurality of scalers such that the operator can, in fact, cover a greater area in the same amount of time.

It is another object of the present invention to provide a holder for a plurality of scalers such that the scalers can be operated with maximum contact with the surface and consistently at the appropriate relationship thereto.

It is still a further object of the present invention to provide a holder for a plurality of scrapers or the like wherein axial adjustments to the location of the individual scrapers may easily be made.

It is still a further object of the present invention to provide a holder for a plurality of scrapers or the like wherein an individual scraper may be quickly and easily removed for use by itself.

Figure 1:
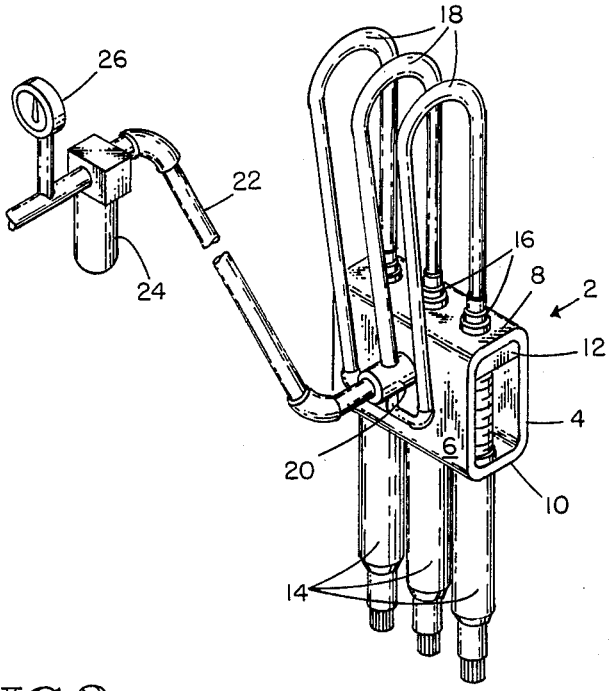
FIG. 1 is a pictorial representation of inventive multiple scaler holder with the scalers and the necessary support in position.
Figure 2:
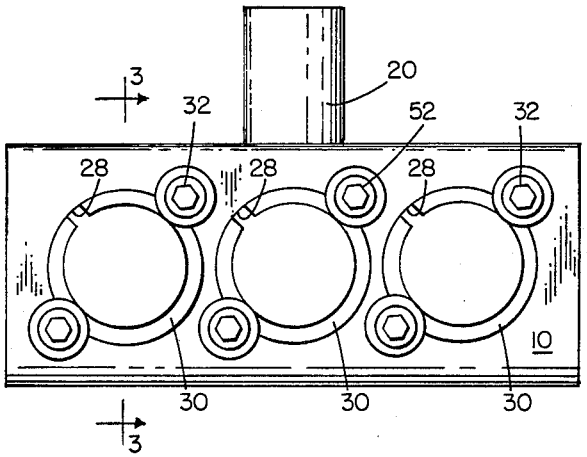
FIG. 2 is a plan view of the inventive holder with the scalers removed.

FIG. is an elevational view taken along lines 3—3 of FIG. 2.

DETAILED DESCRIPTION OF THE DRAWINGS

As seen in FIG. 2, the inventive tool holder, generally designated as 2, has a main body portion fabricated of hollow rectangular tubing having parallel sides 4 and 6, and parallel top and bottom 8, 10. As will be explained hereinafter, the top portion 8 is reinforced as at 12.

Three scaling tools 14 extend through a plurality of openings in bottom 10 and extend upwardly into the interior of tool holder 2 where they are adjustably secured to the top 8 as explained hereinafter. Extending through the top 8 are three fixtures 16 to which are connected three hoses 18, preferrably by quick-disconnect coupling. The hoses terminate in a manifold 20 which is supplied air under pressure by conduit 22 which may also serve as a handle. To be noticed also in this view is the filter/oil mechanism 24 and gauge member 26.

Referring now to FIG. 2, which as noted above is a bottom plan view, it can be seen that the bottom 10 has three holes 28 into which are fitted tapered nylon bushings 30 which are held into position by a plurality of threaded fastening members 32.

Figure 3:
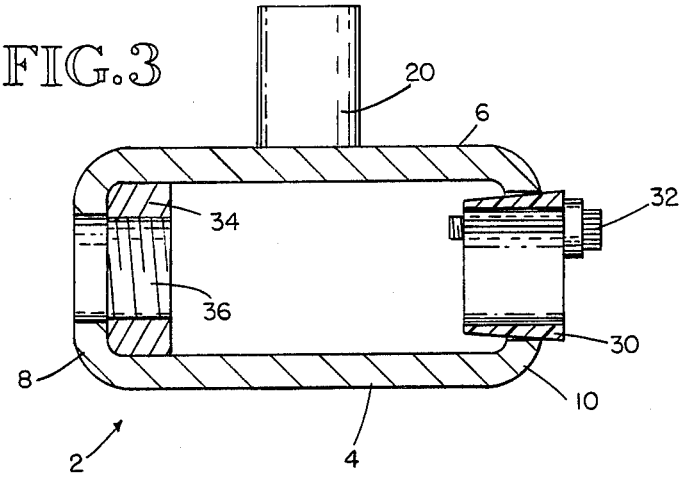

As seen in FIG. 3, the tool holder 2 has a reinforcing member 34 secured to the interior of the body adjacent the top 8. The interior of reinforcing member 34 has female threads as at 36 to accept the male threads of the scaler (not shown) such that the scaler when in position may be axially adjusted to control the position of the various tools within the holders assuring that the tools have uniform contact with the surface being scaled.

The tapered bushing 30 may also be seen as well as the fastening member 32 which is threadingly engaged with the bottom 10 of the tool holder.

Thus, as can be seen, the present invention permits a single operator to simultaneously operate three tools, increasing his efficiency and yet permits individual axial adjustment of the tools assuring uniform contact and further allows individual tools to be removed for operation in a tight spot or in a spot that needs additional individually controlled work. The continuous impact supports the mechanism and allows easy movement of the tool.

I claim:

1. A device for supporting a plurality of scalers or the like for simultaneous usage comprising;

a main body element fabricated of rectangular tubing including an upper portion having a plurality of threaded bores to adjustably receive the scalers having complementary threads and a plurality of bottom bores coaxial with the threaded bores, said bottom bores including bushings to prevent lateral movement of the bottoms of the scalers during use and means for retaining the bushings in their respective bores.

2. A device as in claim 1 wherein the bushings are tapered.

3. A device as in claim 1 wherein the upper surface of the main body portion is reinforced.

* * * * *